US008721801B2

(12) United States Patent
Smith

(10) Patent No.: US 8,721,801 B2
(45) Date of Patent: May 13, 2014

(54) METHOD OF USING RINSE AID COMPOSITIONS IN AUTOMATIC DISHWASHING MACHINES

(75) Inventor: Kim R. Smith, Woodbury, MN (US)

(73) Assignee: Ecolab USA Inc., St. Paul, MN (US)

( * ) Notice: Subject to any disclaimer, the term of this patent is extended or adjusted under 35 U.S.C. 154(b) by 77 days.

(21) Appl. No.: 12/844,013

(22) Filed: Jul. 27, 2010

(65) Prior Publication Data

US 2010/0288309 A1 Nov. 18, 2010

Related U.S. Application Data

(62) Division of application No. 11/986,219, filed on Nov. 20, 2007, now abandoned.

(51) Int. Cl.
*B08B 3/00* (2006.01)
*C11D 3/00* (2006.01)

(52) U.S. Cl.
USPC ..... 134/25.2; 510/220

(58) Field of Classification Search
None
See application file for complete search history.

(56) References Cited

U.S. PATENT DOCUMENTS

| | | | | |
|---|---|---|---|---|
| 4,844,828 | A | 7/1989 | Aoki | |
| 5,672,390 | A | 9/1997 | Crews, IV et al. | |
| 6,693,071 | B2 | 2/2004 | Ghosh et al. | |
| 6,955,834 | B2 | 10/2005 | Rohrbaugh et al. | |
| 7,087,662 | B2 | 8/2006 | Ghosh et al. | |
| 7,196,044 | B2 | 3/2007 | Smith et al. | |
| 2004/0144408 | A1 * | 7/2004 | Sakane et al. | 134/58 D |
| 2004/0173244 | A1 * | 9/2004 | Strothoff et al. | 134/25.2 |
| 2005/0020464 | A1 * | 1/2005 | Smith et al. | 510/220 |

* cited by examiner

*Primary Examiner* — Nicole Blan
(74) *Attorney, Agent, or Firm* — Amy J. Hoffman

(57) ABSTRACT

A method of warewashing is provided. A combination detergent rinse aid composition is used according to the invention. The warewashing detergent composition includes an alkaline source and a water-soluble anion. The rinse aid composition comprises an acid. The alkaline source is provided in an amount effective to provide a use composition having a pH of at least about 8. The anion is present in sufficient amount to leave a residue of anions on the surface of the wares. The acid of the rinse aid has a sufficiently low pKa to react with the anions to form an insoluble oxide on the surface of the wares. The insoluble oxide reduces the surface tension of water on the surface of the wares thus reducing water spotting. Methods for using and manufacturing a combination warewashing detergent-rinse aid composition are provided.

13 Claims, No Drawings

METHOD OF USING RINSE AID COMPOSITIONS IN AUTOMATIC DISHWASHING MACHINES

CROSS-REFERENCE TO RELATED APPLICATIONS

This application claims priority to U.S. patent application Ser. No. 11/986,219 filed on Nov. 20, 2007, now abandoned and entitled "Rinse Aid Composition For Use In Automatic Dishwashing Machines, And Methods For Manufacturing And Using," the disclosure of which is incorporated herein by reference in its entirety for all purposes.

FIELD OF THE INVENTION

The invention relates to combination detergent and rinse aid compositions, methods and articles of manufacture comprising in situ generation of a nanoparticle system to impart surface modifying benefits for all types of hard surfaces.

The use of the detergent and rinse aid of the invention allows for the creation of nanoparticles in situ providing benefits that include at least one of the following improved surface properties: wetting and sheeting, uniform drying, anti-spotting, anti-staining, anti-filming, and self cleaning relative to dishware surfaces unmodified with such nanoparticle systems. In situ generation of nanoparticles overcomes the many drawbacks associated with incorporating preexisting nanoparticles into a rinse aid product. Combination detergent and rinse aid compositions of the invention are useful in automatic dishwashing machines including commercial and/or domestic dishwashing machines.

BACKGROUND OF THE INVENTION

Hard surfaces that are washed but not dried often suffer from spotting. In particular, glassware, dishes, and cutlery washed in an automatic dishwasher may develop hard water spots. Such hard water spots are undesirable because they have an undesirable appearance causing the clean objects to appear dirty. To overcome this problem, rinse aids are often used to minimize or hopefully eliminate such spotting.

Some commercially available rinse aids include nanoparticles. Adding nanoparticles to rinse aids provide desirable results in improving sheeting, thus reducing hard water spots. However, incorporating nanoparticles into rinse aids has its drawbacks. While the benefits of including nanoparticles are impressive, the drawbacks may outweigh the advantages. Incorporating nanoparticles into a detergent or rinse aid is expensive. Nanoparticles may be purchased commercially from vendors, but in the detergent and rinse aid market, it is often a prohibitively expensive ingredient. While nanoparticles are sold commercially, their availability is largely limited because many vendors do not sell them nor do many manufacturers manufacture them. Additionally, nanoparticles can be difficult and dangerous to handle. They pose a potential hazard to workers who risk aspirating the minute particles into their respiratory system resulting in serious health problems. Another drawback is that the nanoparticles often clump or agglomerate thus reducing or eliminating their effectiveness. Agglomeration results in particles that are not present in the form of discrete particles, but instead predominantly assume the form of agglomerates due to consolidation of the primary particles. Such agglomerates may reach diameters of several thousand nanometers, such that the desired characteristics associated with the nanoscale nature of the particles cannot be achieved. If agglomeration occurs, an expensive, dangerous to handle ingredient loses its ability to improve sheeting and reduce hard water spots.

It is apparent that there is a continuing need to improve the various properties of all dishware surfaces in automatic dishwashers, including but not limited to glass, plastics, metals, and ceramic surfaces. Such improvement would result in dishware surfaces having one or more of the following highly desirable modified surface properties such as improved wetting and sheeting, uniform drying, anti-spotting, anti-staining, anti-filming, and durability. Desirably, such improvement would provide the benefits of including nanoparticles into the composition yet would exclude all of the drawbacks associated with inclusion of such an ingredient in the composition.

SUMMARY OF THE INVENTION

A warewashing detergent and combination rinse aid composition is provided according to the invention. The warewashing composition includes an alkaline cleaning agent comprised of a source of a water-soluble anion, and a rinse aid comprised of an acid capable of forming a water insoluble oxide as a precipitate with the anion source. Without being bound by theory, it is believed that the oxide precipitate that forms is akin to or are actually nanoparticulates. The oxide precipitate acts as a coating on the wares thus providing dishware surfaces having one or more of the following highly desirable modified surface properties such as improved wetting and sheeting, uniform drying, anti-spotting, anti-staining, anti-filming, and durability. From an appearance standpoint an important improvement is reducing the untoward appearance of water spots. In short, it is believed that the detergent/rinse aid combination composition provides in situ production of nanoparticles thus providing a composition with all of the benefits of including nanoparticles yet obviating the need to purchase or handle nanoparticles. Additionally, there is little risk of agglomeration of the nanoparticles since they are created in situ.

In order to produce the nanoparticles in situ, a sufficient amount of the water-soluble anion must be present to leave a residue on the wares. The residual water-soluble anion is then available to react with the acid of the rinse aid thus forming an insoluble oxide and coating the surfaces of the wares with the oxide.

Alternatively, one may practice the invention in the reverse order. That is, the wares may first be treated with an acid that remains on the surface of the wares. The acid treatment is then followed by treatment with alkaline water-soluble anion. The water-soluble anion reacts to form an insoluble oxide with the residual acid present on the wares coating the surfaces of the wares with the oxide. The oxide precipitate then improves the wetting characteristics of the ware surfaces resulting in reduced water spots.

A method for using a warewashing detergent-rinse aid combination composition is provided according to the invention. The method can include steps of diluting a warewashing detergent rinse aid combination composition with water at a dilution ratio of water to warewashing detergent composition of at least about 20:1, and washing ware with the use composition in an automatic dishwashing machine.

A method for using a combination detergent and rinse aid composition is provided according to the invention. The method can include steps of diluting a composition with water at a dilution ratio of water to detergent-rinse aid composition of at least about 20:1 and washing a hard surface with the use composition. Exemplary hard surfaces that can be washed include glass and ceramic. Exemplary glass surfaces include windows and mirrors.

DETAILED DESCRIPTION OF THE INVENTION

The invention provides a combination warewashing detergent and rinse aid composition for protecting articles such as glassware from water spots in an automatic dishwashing or warewashing machine during automatic dishwashing or warewashing. The invention provides improved washed dishware surfaces having one or more of the following highly desirable modified surface properties such as improved wetting and sheeting, uniform drying, anti-spotting, anti-staining, anti-filming, and durability.

According to the invention, an alkaline water-soluble detergent is provided having an anion source comprised of at least silicate or aluminate, or a combination of both. As used herein, the term "alkaline" refers to those compositions having a pH above 7, or more preferably, a pH above 8. In addition, a cleaning composition is provided according to the invention that can be used in environments other than inside a dishwashing machine.

The anion of the detergent is provided in sufficient amount to leave a residue remaining upon the wares. As used herein, the terms "residue" or "coating" include substantially covering a surface, or portion thereof, as well as only partially covering a surface, such as those residues or coatings that after drying leave gaps in coverage on a surface. When it is said that the detergent ions leave a residue or coating as described herein, it is understood that the residues or coatings need not cover the entire surface. For instance, the residual anions or coatings are considered applied to a surface even if they modify a portion of the surface.

Preferably, the anions provided in the detergent are comprised of silicate or aluminate. The composition of the anions is important, as the anions should be soluble in water during the detersive phase of the ware washing. Once contacted with the acidic rinse aid, the anions form an oxide precipitate.

An acid preferably serves as the rinse aid. The acidic rinse aid preferably has a pH low enough to cause the residual anions present on the ware surfaces to form an oxide precipitate. Such a pH is preferably below 7, and more preferably below 6. One skilled in the art will recognize that the amount of rinse aid necessary will in part depend upon the pH of the acidic rinse aid.

It is believed that the anionic oxide precipitate is formed substantially on the surface of the wares. The oxide precipitate is preferably a fine precipitate that is undetected by the naked eye. As such, it is referred to as a nanoparticulate. Such nanoparticles have novel and useful properties due to the very small dimensions of the particulates. Nanoparticles, as used herein are particles with diameters of about 500 nm or less. Particle size distributions of the nanoparticles in the present invention may fall anywhere within the range from about 1 nm, or less, to less than about 500 nm, alternatively from about 1 nm to less than about 100 nm, and alternatively from about 1 nm to less than about 50 nm. Alternatively, nanoparticles can also include crystalline or amorphous particles with a particle size from about 1, or less, to about 100 nanometers, alternatively from about 1 to about 50 nanometers.

It is believed that use of the combined warewashing detergent and rinse aid of the invention would serve to create a layer on glassware in particular to help inhibit the etched appearance commonly found when glass is repeatedly washed in an automatic dishwasher. Without being bound by theory, it is likely that the anionic oxide particulates, also referred to herein as the in situ created nanoparticles, create a sacrificial layer on the glassware prohibiting or reducing leaching of the silicon in the glass. Practicing the invention could therefore prolong the clarity of glass routinely washed in automatic dishwashing machines.

The combination warewashing detergent and rinse aid composition can be referred to as a cleaning composition and can be available for cleaning in environments other than inside an automatic dishwashing or warewashing machine. It should be understood that the term "warewashing" refers to and is meant to include both warewashing and dishwashing. Furthermore, the warewashing composition can refer to a concentrate and to a use composition. In general, a concentrate is the composition that is diluted with water to provide the use composition that contacts the ware surfaces to provide the desired effect, such as, cleaning.

One skilled in the art will appreciate that the combination warewashing detergent and rinse aid composition of the invention may be provided in different embodiments. In a first embodiment, the warewashing component may be provided in a stand-alone detergent that may be provided in solid or liquid form. The rinse aid component may then also be provided in a stand-alone format and may be provided in solid or liquid form. In this embodiment, either the rinse aid component or the warewashing component may be used as the first treatment. Alternatively, the stand-alone components of this embodiment may simultaneously treat the wares.

In a second embodiment the warewashing detergent component and the rinse aid component are provided together. The combined detergent-rinse aid may be provided such that when diluted with water either the detergent component or the rinse aid component is dispersed first. That is, one of the components is more readily diluted with water allowing only one of the components to first contact the wares until the second component is diluted with water then allowing the second component to contact the wares. This is accomplished by providing both of the components in solid form or by providing one of the components in liquid form and the other in solid form.

The combination warewashing-rinse aid composition that contacts the articles to be washed in an automatic dishwashing process can be referred to as the use composition. The use composition for the detergent composition can be provided at a solids concentration that provides a desired level of detersive properties. The solids concentration refers to the concentration of the non-water components in the use composition. The warewashing composition prior to dilution to provide the use composition can be referred to as the warewashing composition concentrate or more simply as the concentrate. The concentrate can be provided in various forms including as a liquid and as a solid. It should be understood that pastes and gels can be considered a type of liquid. In addition, it should be understood that powders, agglomerates, pellets, tablets, and blocks are types of a solid.

The rinse aid composition useful in an automatic dishwashing process can be referred to as the use composition. The use composition for the rinse aid composition can be provided at a solids concentration that provides a desired level of oxide precipitate to occur when reacting with the anion of the detersive agent. The solids concentration refers to the concentration of the non-water components in the rinse aid use composition. The rinse aid composition prior to dilution to provide the use composition can be referred to as the rinse aid composition concentrate or more simply as the concentrate. As with the detergent, the rinse aid concentrate can be provided in various forms including as a liquid and as a solid. It should be understood that pastes and gels can be considered a type of liquid. In addition, it should be understood that powders, agglomerates, pellets, tablets, and blocks are types of a solid.

It is expected that the combination warewashing detergent-rinse aid composition will be used by diluting the concentrate with water at the situs or location of use to provide the use composition. In many cases when using the combination warewashing detergent-rinse aid composition in an automatic dishwashing or warewashing machine, it is expected that that situs or location of use will be inside the automatic dishwashing or warewashing machine. Although the location of use will generally be inside an automatic dishwashing machine, whether or not the detergent and rinse aid of the invention are combined will depend upon the particular embodiment of the invention used. That is, if the warewashing detergent and rinse aid components of the invention are stand alone components, then the combination warewashing detergent-rinse aid composition is used in a residential or home-style dishwashing machine, it is expected that the warewashing detergent composition may be placed in the detergent compartment of the dishwashing machine and the rinse aid component may be placed in the rinse aid compartment of the dishwashing machine. Often these detergent compartments and rinse aid compartments are located in the door of the dishwashing machine. The warewashing detergent composition and the rinse aid composition can be provided in the form that allows for introduction of a single dose of the composition into the appropriate compartment. In general, single dose refers to the amount of the warewashing or rinse aid composition that is desired for a single warewashing application. In many commercial dishwashing or warewashing machines, and even for certain residential dishwashing machines, it is expected that a large quantity of warewashing or rinse aid composition can be provided in a compartment that allows for the release of a single dose amount of the composition for each warewashing or dishwashing cycle. Such a compartment may be provided as part of the warewashing or dishwashing machine or it may be provided as a separate structure connected to the warewashing or dishwashing machine by a hose for delivery of liquid thereto. For example, a block of the warewashing detergent and/or rinse aid composition can be provided in a hopper, and water can be sprayed against the surface of the block to provide a liquid concentrate that can be introduced into the dishwashing machine. The hopper can be a part of the dishwashing machine or it can be provided separate from the dishwashing machine.

The warewashing detergent use composition can have a solids content that is sufficient to provide the desired level of cleaning while avoiding wasting the warewashing composition by using too much. In general, it is expected that the use composition will have a solids content of at least about 0.05 wt. %, and can have a solids content of between about 0.05 wt. % and about 0.75 wt. %. The use composition can be prepared from the concentrate by diluting with water at a dilution ratio that provides convenient use of the concentrate and provides the formation of a use composition having desired detersive properties. It is expected that the concentrate can be diluted at a ratio of water to concentrate of at least about 20:1, and can be at between about 20:1 and about 200:1, to provide a use composition having desired detersive properties.

The warewashing detergent composition can be provided in the form of a solid. Exemplary solid dishwashing compositions are disclosed in U.S. Pat. No. 6,410,495 to Lentsch et al., U.S. Pat. No. 6,369,021 to Man et al., U.S. Pat. No. 6,258,765 to Wei et al, U.S. Pat. No. 6,177,392 to Lentsch et al., U.S. Pat. No. 6,164,296 to Lentsch et al., U.S. Pat. No. 6,156,715 to Lentsch et al., and U.S. Pat. No. 6,150,324 to Lentsch et al. The compositions of each of these patents are incorporated herein by reference.

Ionic Source

As stated previously, the detergent is comprised of at least one anion of silicate or aluminate. The ionic source also refers to the possibility that a combination of aluminate ion and silicate ions are provided. The amount of anion provided in the detergent is sufficient to provide a residue or coating on the dishes or wares to be washed. The ionic source preferably remains in solution until the acidic rinse aid contacts the ions. In order to achieve this, the detergent or ionic source carrier preferably remains alkaline. If the pH of the ionic source carrier dips too low below neutral, a precipitate may form prematurely. If the precipitate or insoluble oxide forms prematurely, one is faced with the drawbacks of using nanoparticles as an ingredient. That is, there is a risk of agglomeration of the nanoparticles resulting in the nanoparticles losing much if not all of their effectiveness as a wetting or sheeting agent. In an alternate embodiment, the oxide precipitate may form before contacting the wares. This will occur when the acid rinse and alkaline anions come into contact. If this is the case, it is preferred that agitation accompany the nanoparticulate formation to ensure that large oxide agglomerates are not formed. It is not entirely clear what exact ions are present in the use composition. For example, when the use composition is alkaline, it is expected that the aluminum ion may be available as an aluminate ion. Accordingly, it should be understood that the terms "aluminum ion" and "silicon ion" refer to ions that contain aluminum and silicon, respectively. The terms "aluminate ion" and "silicate ion" are not limited to elemental aluminum provided as an ion and elemental silicon provided as an ion, respectively.

Any component that provides an aluminum ion in a use composition can be referred to as a source of aluminum ion, and any component that provides a silicate ion when provided in a use composition can be referred to as a source of silicate ion. It is not necessary for the source of aluminum ion and/or the source of silicon ion to react to form the aluminum ion and/or the silicon ion. It should be understood that aluminum ion can be considered a source of aluminum ion, and silicate ion can be considered a source of silicate ion. The source of aluminum ion and the source of silicate ion can be provided as organic salts, inorganic salts, and mixtures thereof. Exemplary sources of aluminum ion include aluminum salts such as sodium aluminate, potassium aluminate, lithium aluminate, and mixtures thereof. Exemplary sources of silicate ion include sodium silicate, sodium orthosilicate, sodium metasilicate, potassium silicate, potassium orthosilicate, potassium metasilicate, lithium silicate, lithium orthosilicate, lithium orthosilicate, lithium metasilicate, and mixtures thereof. In addition, the source of aluminum ion and the source of silicate ion can be selected as those components that are characterized by the United States Food and Drug Administration as direct or indirect food additives. Because the warewashing detergent composition will be used to wash articles that contact food, it may be desirable to select the source of aluminum ion and the source of silicate ion as components that are characterized by the United States Food and Drug Administration as direct or indirect food additives. By way of theory, it is believed that the source of aluminum ion and the source of silicate ion provide aluminum ion and silicate ion, respectively, that deposit onto the surfaces of articles that are being washed. In addition, it is believed that the acidic rinse aid causes the ions to precipitate. The precipitate remains on the article to improve wetting, sheeting, uniform drying, anti-spotting, anti-staining, anti-filming, and reduces the untoward appearance of water spots It is expected that the ionic source will form a water insoluble oxide when contacted with the acidic rinse aid and precipitate onto the glass surface. The water insoluble oxide is also referred to herein as nanoparticles. As a result, the film that forms on the glass surface by the precipitate can be substantially invisible to the human eye. It should be understood that the phrase "substantially invisible to the human eye" refers to the lack of visible filming by the nanoparticulates. Visible filming refers to a cloudy appearance that may begin with an iridescent film that displays rainbow hues in light reflected from the glass. It is expected that the precipitate that forms on the glass provides a film on the glass that is both substantially invisible to the human eye and that provides a functional layer. By functional layer it is meant that nanoparticulates provide modified surface properties on the wares such as improved wetting and sheeting, uniform drying, anti-spotting, anti-staining, anti-filming, and durability.

Alkaline Sources

The warewashing composition according to the invention may include an effective amount of one or more alkaline sources to maintain the detergent at an alkaline pH and preventing the anion from precipitating to form an oxide. The alkaline source may also enhance cleaning of a substrate and improve soil removal performance of the composition. In general, an effective amount of one or more alkaline sources should be considered as an amount that provides a use composition having a pH of at least about 8. When the use composition has a pH of between about 8 and about 10, it can be considered mildly alkaline, and when the pH is greater than about 12, the use composition can be considered caustic. In general, it is desirable to provide the use composition as a mildly alkaline cleaning composition because it is considered safer than the caustic based use compositions.

The warewashing composition can include a sufficient amount of the alkaline source to provide the use composition with a pH of at least about 8. In general, it is expected that the concentrate will include the alkaline source in an amount of at least about 5 wt. %, at least about 10 wt. %, or at least about 15 wt. %. In order to provide sufficient room for other components in the concentrate, the alkaline source can be provided in the concentrate in an amount of less than about 60 wt. %. In addition, the alkaline source can be provided at a level of less than about 30 wt. % and less than about 20 wt. %. It is expected that the warewashing composition may provide a use composition that is useful at pH levels below about 8. In such compositions, an alkaline source may be omitted, and additional pH adjusting agents may be used to provide the use composition with the desired pH. Accordingly, it should be understood that the source of alkalinity could be characterized as an optional component.

Cleaning Agent

The warewashing detergent composition can include at least one cleaning agent comprising a surfactant or surfactant system. Beyond the anionic source, a variety of surfactants can be used in a warewashing composition, such as additional anionic, nonionic, cationic, and zwitterionic surfactants. It should be understood that surfactants are an optional component of the warewashing composition and can be excluded from the concentrate. The warewashing detergent composition, when provided as a concentrate, can include the cleaning agent in a range of between about 0.5 wt. % and about 20 wt. %, between about 0.5 wt. % and about 15 wt. %, between about 1.5 wt. % and about 15 wt. %, between about 1 wt. % and about 10 wt. %, and between about 2 wt. % and about 5 wt. %. Additional exemplary ranges of surfactant in a concentrate include about 0.5 wt. % to about 5 wt. %, and about 1 wt. % to about 3 wt. %.

Exemplary surfactants that can be used are commercially available from a number of sources. For a discussion of surfactants, see Kirk-Othmer, Encyclopedia of Chemical Technology, Third Edition, volume 8, pages 900-912. When the warewashing composition includes a cleaning agent, the cleaning agent can be provided in an amount effective to provide a desired level of cleaning Anionic surfactants useful in the warewashing composition includes, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Exemplary anionic surfactants include sodium alkylarylsulfonate, alpha-olefinsulfonate, and fatty alcohol sulfates.

Nonionic surfactants useful in the warewashing detergent composition include, for example, those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC® (BASF-Wyandotte), and the like; and other like nonionic compounds. Silicone surfactants such as the ABIL® B8852 can also be used.

Cationic surfactants that can be used in the warewashing detergent composition include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl ($C_{12}$-$C_{18}$)dimethylbenzyl ammonium chloride, n-tetradecyldimethylbenzylammonium chloride monohydrate, a naphthylene-substituted quaternary ammonium chloride such as dimethyl-1-naphthylmethylammonium chloride, and the like. The cationic surfactant can be used to provide sanitizing properties.

Zwitterionic surfactants that can be used in the warewashing composition include betaines, imidazolines, and propinates. Because the warewashing composition is intended for use in an automatic dishwashing or warewashing machine, the surfactants selected, if any surfactant is used, can be those that provide an acceptable level of foaming when used inside a dishwashing or warewashing machine. It should be understood that warewashing compositions for use in automatic dishwashing or warewashing machines are generally considered to be low-foaming compositions.

The surfactant can be selected to provide low foaming properties. One would understand that low foaming surfactants that provide the desired level of detersive activity are advantageous in an environment such as a dishwashing machine where the presence of large amounts of foaming can be problematic. In addition to selecting low foaming surfactants, one would understand that defoaming agents could be utilized to reduce the generation of foam. Accordingly, surfactants that are considered low foaming surfactants as well as other surfactants can be used in the warewashing composition and the level of foaming can be controlled by the addition of a defoaming agent.

Other Additives

The warewashing detergent composition can include other additives, including conventional additives such as chelating/sequestering agents, bleaching agents, detergent builders or fillers, hardening agents or solubility modifiers, defoamers, anti-redeposition agents, threshold agents, stabilizers, dispersants, enzymes, aesthetic enhancing agents (i.e., dye, perfume), and the like. Adjuvants and other additive ingredients will vary according to the type of composition being manufactured. It should be understood that these additives are optional and need not be included in the cleaning composition. When they are included, they can be included in an amount that provides for the effectiveness of the particular type of component.

The warewashing composition can include chelating/sequestering agents such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. In general, chelating/sequestering agents can generally be referred to as a type of builder. The chelating/sequestering agent may also function as a threshold agent when included in an effective amount. The concentrate can include about 0.1 wt. % to about 70 wt. %, about 5 wt. % to about 60 wt. %, about 5 wt. % to about 50 wt. %, and about 10 wt. % to about 40 wt. % of a chelating/sequestering agent.

Exemplary aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$ (HEDP); amino tri(methylenephosphonic acid) $N[CH_2PO(OH)_2]_3$; aminotri(methylenephosphonate), sodium salt

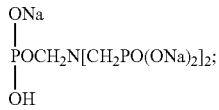

2-hydroxyethyliminobis(methylenephosphonic acid) $HOCH_2CH_2N[CH_2PO(OH)_2]_2$; diethylenetriaminepenta(methylenephosphonic acid) $(HO)_2POCH_2N[CH_2CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis(hexamethylene)triamine(pentamethylenephosphonic acid) $(HO_2)POCH_2N[(CH_2)_6N[CH_2PO(OH)_2]_2]_2$; and phosphorus acid $H_3PO_3$.

Exemplary phosphonates are HEDP, ATMP and DTPMP. A neutralized or alkaline phosphonate, or a combination of the phosphonate with an alkali source prior to being added into the mixture such that there is little or no heat or gas generated by a neutralization reaction when the phosphonate is added is preferred. The phosphonate can comprise a potassium salt of an organo phosphonic acid (a potassium phosphonate). The potassium salt of the phosphonic acid material can be formed by neutralizing the phosphonic acid with an aqueous potassium hydroxide solution during the manufacture of the solid detergent. The phosphonic acid sequestering agent can be combined with a potassium hydroxide solution at appropriate proportions to provide a stoichiometric amount of potassium hydroxide to neutralize the phosphonic acid. A potassium hydroxide having a concentration of from about 1 to about 50 wt % can be used. The phosphonic acid can be dissolved or suspended in an aqueous medium and the potassium hydroxide can then be added to the phosphonic acid for neutralization purposes.

Water conditioning polymers can be used as a form of builder. Exemplary water conditioning polymers include polycarboxylates. Exemplary polycarboxylates that can be used as builders and/or water conditioning polymers include those having pendant carboxylate ($—CO_2^-$) groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. The concentrate can include the water conditioning polymer in an amount of between about 0.1 wt. % and about 5 wt. %, and between about 0.2 wt. % and about 2 wt. %.

Bleaching agents for use in a cleaning compositions for lightening or whitening a substrate, include bleaching compounds capable of liberating an active halogen species, such as $Cl_2$, $Br_2$, $—OCl^-$ and/or $—OBr^-$, under conditions typically encountered during the cleansing process. Suitable bleaching agents for use in the present cleaning compositions include, for example, chlorine-containing compounds such as a chlorine, a hypochlorite, chloramine. Exemplary halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The composition can include an effective amount of a bleaching agent. When the concentrate includes a bleaching agent, it can be included in an amount of about 0.1 wt. % to about 60 wt. %, about 1 wt. % to about 20 wt. %, about 3 wt. % to about 8 wt. %, and about 3 wt. % to about 6 wt. %.

The composition can include an effective amount of detergent fillers, which does not perform as a cleaning agent per se, but cooperates with the cleaning agent to enhance the overall cleaning capacity of the composition. Examples of detergent fillers suitable for use in the present cleaning compositions include sodium sulfate, sodium chloride, starch, sugars, $C_1$-$C_{10}$ alkylene glycols such as propylene glycol, and the like. When the concentrate includes a detergent filler, it can be included an amount of about 1 wt. % to about 20 wt. % and between about 3 wt. % to about 15 wt. %.

A defoaming agent for reducing the stability of foam may also be included in the composition to reduce foaming. When the concentrate includes a defoaming agent, the defoaming agent can be provided in an amount of between about 0.01 wt. % and about 3 wt. %.

Examples of defoaming agents that can be used in the composition includes ethylene oxide/propylene block copolymers such as those available under the name Pluranic N-3, silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

The composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. When the concentrate includes an anti-redeposition agent, the anti-redeposition agent can be included in an amount of between about 0.5 wt. % to about 10 wt. %, and between about 1 wt. % and about 5 wt. %.

Stabilizing agents that can be used include primary aliphatic amines, betaines, borate, calcium ions, sodium citrate, citric acid, sodium formate, glycerine, maleonic acid, organic diacids, polyols, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include about 0 to about 20 wt. %, about 0.5 wt. % to about 15 wt. %, and about 2 wt. % to about 10 wt. %.

Dispersants that can be used in the composition include maleic acid/olefin copolymers, polyacrylic acid, and mixtures thereof. The concentrate need not include a dispersant, but when a dispersant is included it can be included in an amount that provides the desired dispersant properties. Exemplary ranges of the dispersant in the concentrate can be between about 0 and about 20 wt. %, between about 0.5 wt. % and about 15 wt. %, and between about 2 wt. % and about 9 wt. %.

Enzymes that can be included in the composition include those enzymes that aid in the removal of starch and/or protein stains. Exemplary types of enzymes include proteases, alpha-amylases, and mixtures thereof. Exemplary proteases that can be used include those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme. When the concentrate includes an enzyme, it can be included in an amount that provides the desired enzymatic activity when the warewashing composition is provided as a use composition. Exemplary ranges of the enzyme in the concentrate include between about 0 and about 15 wt. %, between about 0.5 wt. % and about 10 wt. %, and between about 1 wt. % and about 5 wt. %.

The concentrate can include water. In general, it is expected that water may be present as a processing aid and may be removed or become water of hydration. It is expected that water may be present in both the liquid concentrate and in the solid concentrate. In the case of the liquid concentrate, it is expected that water will be present in a range of between about 5 wt. % and about 60 wt. %, between about 10 wt. % and about 35 wt. %, and between about 15 wt. % and about 25 wt. %. In the case of a solid concentrate, it is expected that the water will be present in ranges of between about 0 wt. % and about 10 wt. %, about 0.1 wt. % and about 10 wt. %, about 1 wt. % and about 5 wt. %, and about 2 wt. % and about 3 wt. %. It should be additionally appreciated that the water may be provided as deionized water or as softened water.

Various dyes, odorants including perfumes, and other aesthetic enhancing agents can be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

The components used to form the concentrate can include an aqueous medium such as water as an aid in processing. It is expected that the aqueous medium will help provide the components with a desired viscosity for processing. In addition, it is expected that the aqueous medium may help in the solidification process when is desired to form the concentrate as a solid. When the concentrate is provided as a solid, it can be provided in the form of a block or pellet. It is expected that blocks will have a size of at least about 5 grams, and can include a size of greater than about 50 grams. It is expected that the concentrate will include water in an amount of between about 1 wt. % and about 50 wt. %, and between about 2 wt. % and about 40 wt. %.

When the components that are processed to form the concentrate are processed into a block, it is expected that the components can be processed by extrusion techniques or casting techniques. In general, when the components are processed by extrusion techniques, it is believed that the composition can include a relatively smaller amount of water as an aid for processing compared with the casting techniques. In general, when preparing the solid by extrusion, it is expected that the composition can contain between about 2 wt. % and about 10 wt. % water. When preparing the solid by casting, it is expected that the amount of water can be provided in an amount of between about 20 wt. % and about 40 wt. %.

Rinse Aid Component

According to the invention, once the ionic source is deposited upon the surface of the wares, an acidic rinse aid component is used in combination with the detersive agent. The rinse aid of the invention preferably has a pKa of less than 6, more preferably the rinse aid of the invention comprises a pKa of less than 5, and most preferably the rinse aid of the invention comprises a pKa of less than 4. It is believed that the stronger the acid, or the lower the pKa of the rinse aid component, the less of the rinse aid component that is needed.

As previously mentioned with respect to the detersive agents, the acidic component(s) of the rinse aid are best selected from those components characterized by the United States Food and Drug Administration as direct or indirect food additives. When the rinse aid composition is used to wash articles that contact food, it is desirable to select the source of acid as components that are characterized by the United States Food and Drug Administration as direct or indirect food additives.

The acid of the rinse aid component may be organic or inorganic. Examples of organic acids useful in the present invention include but are not limited to citric acid, acetic acid, glutaric acid, tartaric acid, hydroxyacetic acid, sulphonic acid, gluconic acid, maleic acid, or mixtures thereof. Examples of inorganic acids useful in the rinse aid of the present invention include but are not limited to hydrochloric acid, sulphuric acid, sodium hydrogen sulfate, phosphoric acid, nitric acid, or mixtures thereof. One skilled in the art will also recognize inorganic and organic acids may be combined to form the rinse aid composition of the invention.

Forming the Concentrate

As previously mentioned, the detergent may be formed separate of the rinse aid or the rinse aid and detergent may be formed together. The following may refer to either the formation of the detergent concentrate, the rinse aid concentrate or a combination of both. It is noted that it is desirable if the rinse acid and the anionic source contact the wares at different times to that the nanoparticulates do not form prematurely resulting in agglomeration or otherwise undesirable effect. Therefore, it is desirable if the detergent and rinse aid are formed into a single concentrate that either the anion or the acid is encapsulated or otherwise treated to delay delivery to the wares until after the other has contacted or coated the wares. Such encapsulation may be achieved through the use of water soluble polymers or similar methods. The components can be mixed and extruded or cast to form a solid such as pellets or blocks. Heat can be applied from an external source to facilitate processing of the mixture.

A mixing system provides for continuous mixing of the ingredients at high shear to form a substantially homogeneous liquid or semi-solid mixture in which the ingredients are distributed throughout its mass. The mixing system includes means for mixing the ingredients to provide shear effective for maintaining the mixture at a flowable consistency, with a viscosity during processing of about 1,000-1,000,000 cP, preferably about 50,000-200,000 cP. The mixing system can be a continuous flow mixer or a single or twin screw extruder apparatus.

The mixture can be processed at a temperature to maintain the physical and chemical stability of the ingredients, such as at ambient temperatures of about 20-80° C., and about 25-55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the cleaning agent, the aqueous medium, and additional ingredients such as a second cleaning agent, a detergent adjuvant or other additive, a secondary hardening agent, and the like. One or more premixes may be added to the mixture.

The ingredients are mixed to form a substantially homogeneous consistency wherein the ingredients are distributed substantially evenly throughout the mass. The mixture can be discharged from the mixing system through a die or other shaping means. The profiled extrudate can be divided into useful sizes with a controlled mass. The extruded solid can be packaged in film. The temperature of the mixture when discharged from the mixing system can be sufficiently low to enable the mixture to be cast or extruded directly into a packaging system without first cooling the mixture. The time between extrusion discharge and packaging can be adjusted to allow the hardening of the detergent block for better handling during further processing and packaging. The mixture at the point of discharge can be about 20-90° C., and about 25-55° C. The composition can be allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained preferably at about 20-90° C.

When processing of the ingredients is completed, the mixture may be discharged from the mixer through a discharge die. The composition eventually hardens due to the chemical reaction of the ingredients forming the E-form hydrate binder. The solidification process may last from a few minutes to about six hours, depending, for example, on the size of the cast or extruded composition, the ingredients of the composition, the temperature of the composition, and other like factors. Preferably, the cast or extruded composition "sets up" or begins to hardens to a solid form within about 1 minute to about 3 hours, preferably about 1 minute to about 2 hours, preferably about 1 minute to about 20 minutes.

The concentrate can be provided in the form of a liquid. Various liquid forms include gels and pastes. Of course, when the concentrate is provided in the form of a liquid, it is not necessary to harden the composition to form a solid. In fact, it is expected that the amount of water in the composition will be sufficient to preclude solidification. In addition, dispersants and other components can be incorporated into the concentrate in order to maintain a desired distribution of components.

The packaging receptacle or container may be rigid or flexible, and composed of any material suitable for containing the compositions produced according to the invention, as for example glass, metal, plastic film or sheet, cardboard, cardboard composites, paper, and the like. Advantageously, since the composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. Preferred packaging used to contain the compositions is manufactured from a flexible, easy opening film material.

The packaging material can be provided as a water-soluble packaging material such as a water-soluble packaging film. Exemplary water-soluble packaging films are disclosed in U.S. Pat. Nos. 6,503,879; 6,228,825; 6,303,553; 6,475,977; and 6,632,785, the disclosures of which are incorporated herein by reference. An exemplary water-soluble polymer that can provide a packaging material that can be used to package the concentrate includes polyvinyl alcohol. The packaged concentrate can be provided as unit dose packages or multiple dose packages. In the case of unit dose packages, it is expected that a single packaged unit will be placed in a dishwashing machine, such as the detergent compartment of the dishwashing machine, and will be used up during a single wash cycle. In the case of a multiple dose package, it is expected that the unit will be placed in a hopper and a stream of water will degrade a surface of the concentrate to provide a liquid concentrate that will be introduced into the dishwashing machine.

Suitable water-soluble polymers that may be used in the invention are described in Davidson and Sittig, *Water Soluble* Resins, Van Nostrand Reinhold Company, New York (1968), herein incorporated by reference. The water-soluble polymer should have proper characteristics such as strength and pliability in order to permit machine handling. Preferred water soluble polymers include polyvinyl alcohol, cellulose ethers, polyethylene oxide, starch, polyvinylpyrrolidone, polyacrylamide, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resin series, polyethyleneimine, ethyl hydroxyethylcellulose, ethyl methylcellulose, hydroxyethyl methylcellulose. Lower molecular weight water soluble, polyvinyl alcohol film-forming polymers are generally, preferred. Polyvinyl alcohols that can be used include those having a weight average molecular weight of between about 1,000 and about 300,000, and between about 2,000 and about 150,000, and between about 3,000 and about 100,000.

The cleaning composition made according to the present invention is dispensed from a spray-type dispenser such as that disclosed in U.S. Pat. Nos. 4,826,661, 4,690,305, 4,687, 121, 4,426,362 and in U.S. Pat. Nos. Re 32,763 and 32,818, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use. When used, the product can be removed from the package (e.g.) film and is inserted into the dispenser. The spray of water can be made by a nozzle in a shape that conforms to the solid detergent shape. The dispenser enclosure can also closely fit the detergent shape in a dispensing system that prevents the introduction and dispensing of an incorrect detergent.

While the invention is described in the context of a warewashing composition for washing articles in an automatic dishwashing machine, it should be understood that the warewashing composition can be used for washing non-ware items. That is, the warewashing composition can be referred to as a cleaning composition and can be used to clean various items and, in particular, any items that may suffer from water spotting. Examples of other uses of the composition of the invention include but are not limited to car washes, window washes, shower stall cleaners, to name a few. It should be understood that certain components that may be included in a warewashing composition because it is intended to be used in an automatic dishwashing machine can be excluded from a cleaning composition that is not intended to be used in an automatic dishwashing machine, and vice versa. For example, surfactants that have a tendency to create quite a bit of foaming may be used in a cleaning composition that is not intended to be used in an automatic dishwashing machine.

The warewashing composition can be provided in several forms including solids and liquids. When provided in the form of a solid, the warewashing composition can be provided in the form of powder, granules, pellets, tablets, blocks, cast solids, and extruded solids. By way of example, pellets can have sizes of between about 1 mm and about 10 mm diameter, tablets can have sizes of between about 1 mm and about 10 mm diameter, tablets can have sizes of between about 1 cm and about 10 cm diameter, and blocks can have sizes of at least about 10 cm diameter. When provided in the form of a liquid, the warewashing composition can be provided as a gel or a paste. Exemplary ranges for components of the warewashing composition when provided as a gel or a paste are shown in Table 1. Exemplary ranges for components of the warewashing composition when provided as a solid are shown in Table 2.

TABLE 1

Gel or Paste Warewashing Composition (wt. %)

| Component | First Exemplary Range | Second Exemplary Range | Third Exemplary Range |
|---|---|---|---|
| Water | 5-60 | 10-35 | 15-25 |
| Alkaline Source | 5-60 | 10-30 | 15-20 |
| Ionic Source | 5-35 | 10-25 | 15-20 |
| Builder | 1-30 | 3-20 | 6-15 |
| Stabilizer | 0-20 | 0.5-15 | 2-10 |
| Dispersant | 0-20 | 0.5-15 | 2-9 |
| Enzyme | 0-15 | 0.5-10 | 1-5 |
| Corrosion Inhibitor | 0.5-15 | 1-10 | 2-5 |
| Surfactant | 0.5-15 | 1-10 | 2-5 |
| Fragrance | 0-10 | 0.01-5 | 0.1-2 |
| Dye | 0-1 | 0.001-0.5 | 0.01-0.25 |

TABLE 2

| Solid Warewashing Composition (wt. %) | | | |
|---|---|---|---|
| Component | First Exemplary Range | Second Exemplary Range | Third Exemplary Range |
| Water | 0-10 | 1-5 | 2-3 |
| Alkaline Source | 5-60 | 10-30 | 15-20 |
| Builder | 1-60 | 25-50 | 35-45 |
| Bleach | 1-55 | 15-45 | 25-35 |
| Ionic Source | 1-35 | 5-25 | 10-15 |
| Dispersant | 0-10 | 0.001-5 | 0.01-1 |
| Enzyme | 0-15 | 1-10 | 2-5 |
| Corrosion Inhibitor | 0.5-15 | 1-10 | 2-5 |
| Surfactant | 0.5-15 | 1-10 | 2-5 |
| Fragrance | 0-10 | 0.01-5 | 0.1-2 |
| Dye | 0-1 | 0.001-0.5 | 0.01-0.25 |

The various forms of the warewashing composition concentrate can be provided in a water soluble packaging film. That is, solids and liquids can be packaged in the water soluble films. Exemplary solids that can be packaged in a water soluble film include powders, pellets, tablets, and blocks. Exemplary liquids that can be packaged in the water soluble film include gels and pastes.

The above specification provides a basis for broadly understanding the invention. The following examples and test data provide an understanding of certain specific embodiments of the invention. The examples are not meant to limit the scope of the invention that has been set forth in the foregoing description. Variations within the concepts of the invention are apparent to those skilled in the art.

EXAMPLES

The following examples were conducted to compare the contact angle of water based on warewashing compositions and varied order of use. The following procedure was followed to prepare ceramic tiles for the examples:

1. Gloves were worn during washing the tiles to prevent skin oils from contacting the glassware.
2. The ceramic tiles were scrubbed thoroughly with neutral pH liquid dish detergent commercially available as Express™ from Ecolab Inc. to remove dirt and oil.
3. The tiles were allowed to air dry.

Example 1

Three controls were prepared. For the first control (A), ceramic tiles were rinsed with 1000 ppm of purchased nanoparticles. For the second control (B), a tile was treated with citric acid. For the third control (C), the tile was untreated. One tile (D) was treated with a composition according to the present invention. That is, 1000 ppm potassium silicate was used to treat the tile. The tile was then treated with citric acid in order to drop the pH to between about 3 and 4. All tiles were then thoroughly rinsed with tap water and allowed to air dry. The contact angle of deionized water was measured using a goniometer. The lower the contact angle of deionized water, the better the wetting of the surface, and the less likely the surface will show water spotting. Results are shown in the table below:

| Tile | Treatment | Contact Angle (degrees) |
|---|---|---|
| A | 1000 ppm nanoparticles | 14 |
| B | Citric acid | 33 |
| C | Water | 32 |
| D | Potassium silicate/citric acid | 11 |

The results show that tile D, treated according to the invention, performed at least as well or better than the nanoparticle-treated tile A.

Example 2

Tiles were treated in varying order to show that it was inconsequential if the tiles were treated with acid first followed by anion or if they were treated with anion followed by acid. Tile E was treated first with citric acid followed by 1000 ppm potassium silicate. Tile F was treated first with 1000 ppm potassium silicate followed by citric acid. Contact angle of water was measured with a goniometer. Results are shown in the table below:

| Tile sample | Treatment | Contact Angle (degrees) |
|---|---|---|
| E | Acid then anion | 15 |
| F | Anion then acid | 11 |

Example 3

Tiles were treated with different anionic sources as well as different acid sources. Tile G was treated with 1000 ppm potassium silicate followed by citric acid, Tile H was treated with 1000 ppm aluminum silicate followed citric acid, Tile I was treated with 1000 ppm potassium silicate followed by acetic acid, Tile J was treated with 1000 ppm aluminum silicate followed by acetic acid. Contact angle of water was measured with a goniometer. Results are shown in the table below:

| Tile Sample | Treatment | Contact Angle |
|---|---|---|
| G | Sodium aluminate/citric acid | 11 |
| H | Potassium silicate/sulfamic acid | 16 |
| I | Sodium aluminate/sulfamic acid | 20 |
| J | Aluminum silicate/acetic acid | 15 |

As shown in all of the Examples, practicing the invention (as shown by results of samples D, E, F, G, H, I, and J) reduces the contact angle as compared to the controls (samples B and C).

I claim:

1. A method of warewashing, comprising:

(a) providing an alkaline source in an amount effective to provide a cleaning composition with a pH of at least about 8 and between about 10 and 800 ppm of a water-soluble anion selected from silicate or aluminate capable of becoming an insoluble oxide when reacting with an acid source;

(b) first washing wares with the cleaning composition without rinsing such that water-soluble anions remain on the surface of the wares and the washing step is not repeated;

(c) forming a reaction product on the wares by providing an acid having a pKa of less than about 6 that when contacting the residual cleaning agent on the wares comprised of the water-soluble anion causes the water-soluble anion to become an insoluble oxide;

(d) rinsing the wares with water after the acid rinse step; and (e) drying the wares after the water rinse.

2. The method of claim 1, wherein the combination of the alkaline cleaning composition and acidic rinse aid causes a reduction of the surface tension on the surface of the wares to reduce spotting.

3. The method of warewashing according to claim 1, wherein a ware washed according to the method has a contact angle of water of less than 25 degrees.

4. The method of warewashing according to claim 1, wherein a ware washed according to the method has a contact angle of water of less than 20 degrees.

5. The method of warewashing according to claim 1, wherein a ware washed according to the method has a contact angle of water of less than 15 degrees.

6. The method of warewashing according to claim 1, wherein the cleaning composition comprises about 1 wt. % to about 20 wt. % detergent filler.

7. The method of warewashing according to claim 1, wherein the cleaning composition comprises about 0.01 wt. % and about 3 wt. % defoaming agent.

8. The method of warewashing according to claim 1, wherein the cleaning composition comprises about 5 wt. % to about 60 wt. % water.

9. The method of warewashing according to claim 1, wherein the cleaning composition comprises about 0.1 wt. % to about 10 wt. % water.

10. The method of warewashing according to claim 1, wherein the cleaning composition comprises a block having a size of at least about 5 grams

11. The method of warewashing according to claim 1, wherein the cleaning composition further comprises a water-soluble packaging material enclosing the cleaning composition.

12. The method of warewashing according to claim 11, wherein the water-soluble packaging material comprises polyvinyl alcohol.

13. The method of warewashing according to claim 11, wherein the cleaning composition is provided within the water-soluble packaging material in an amount sufficient to provide a unit dose for application in a dishwashing machine.

* * * * *